US010526834B2

(12) United States Patent
Luvison

(10) Patent No.: US 10,526,834 B2
(45) Date of Patent: Jan. 7, 2020

(54) MULLING SYSTEM FOR A WINDOW ASSEMBLY

(71) Applicant: Associated Materials, LLC, Cuyahoga Falls, OH (US)

(72) Inventor: Michael Luvison, Cuyahoga Falls, OH (US)

(73) Assignee: Associated Materials, LLC, Cuyahoga Falls, OH (US)

( * ) Notice: Subject to any disclaimer, the term of this patent is extended or adjusted under 35 U.S.C. 154(b) by 0 days.

(21) Appl. No.: 16/375,350

(22) Filed: Apr. 4, 2019

(65) Prior Publication Data

US 2019/0226268 A1 Jul. 25, 2019

Related U.S. Application Data

(62) Division of application No. 15/714,711, filed on Sep. 25, 2017, now Pat. No. 10,260,274.

(51) Int. Cl.

| | |
|---|---|
| ***E06B 1/36*** | (2006.01) |
| ***E06B 1/52*** | (2006.01) |
| ***E04B 2/96*** | (2006.01) |

(52) U.S. Cl.

CPC ..... *E06B 1/366* (2013.01); *E04B 2/967* (2013.01); *E06B 1/524* (2013.01)

(58) Field of Classification Search

CPC ..... E06B 1/366; E06B 1/524; E04B 2/967

See application file for complete search history.

(56) References Cited

U.S. PATENT DOCUMENTS

| | | | |
|---|---|---|---|
| D240,707 | S | 7/1976 | Rudinski |
| 4,471,597 | A | 9/1984 | Walton |
| 4,686,805 | A | 8/1987 | Forslin |
| 4,837,977 | A | 6/1989 | Mauro |
| 5,083,405 | A | 1/1992 | Miller |
| 5,094,051 | A | 3/1992 | Miller |
| 5,355,645 | A | 10/1994 | Farag |
| 5,435,106 | A | 7/1995 | Garries et al. |
| 5,444,958 | A | 8/1995 | Lu |
| 5,579,616 | A | 12/1996 | Farag |
| 5,632,125 | A | 5/1997 | Osanai |
| 5,655,346 | A | 8/1997 | Holmes et al. |
| 5,678,383 | A | 10/1997 | Danielewicz |
| D392,822 | S | 3/1998 | Gilmore |

(Continued)

*Primary Examiner* — Andrew J Triggs

(74) *Attorney, Agent, or Firm* — Knobbe, Martens, Olson & Bear LLP

(57) ABSTRACT

A mullion assembly is provided for forming a window assembly, the window assembly comprising a first window frame and a second window frame coupled to a monolithic mullion core such that a distal portion of the first window frame is in contact with a proximal surface of the mullion core and a proximal portion of the second window frame is in contact with a distal surface of the mullion core. The mullion assembly further comprises a first and second female connector on a respective first and second side of the mullion core. A plurality of separate compartments is defined along a length of the mullion core vertically between the proximal and distal surfaces and laterally between the first and second female connectors. The mullion assembly further comprises first and second male connectors configured to engage the female connectors and seal the first and second sides of the mullion core.

19 Claims, 10 Drawing Sheets

(56) References Cited

U.S. PATENT DOCUMENTS

| | | | | |
|---|---|---|---|---|
| 5,937,597 | A | 8/1999 | Sono et al. | |
| 6,014,846 | A | 1/2000 | Sono et al. | |
| 6,343,448 | B1 | 2/2002 | Lin | |
| 6,360,498 | B1 | 3/2002 | Westphal | |
| 6,405,504 | B1 | 6/2002 | Richardson | |
| D471,646 | S | 3/2003 | Westphal | |
| 6,662,512 | B2 | 12/2003 | Westphal | |
| D487,936 | S | 3/2004 | Habeck | |
| D494,042 | S | 8/2004 | Wright | |
| 6,857,233 | B2 | 2/2005 | Farag | |
| D513,966 | S | 1/2006 | Wright | |
| D536,822 | S | 2/2007 | Pyshos | |
| 7,434,364 | B2 | 10/2008 | Macdermott | |
| 7,832,160 | B2 | 11/2010 | Farag | |
| D662,613 | S | 6/2012 | Williams | |
| D666,309 | S | 8/2012 | Zhao | |
| D782,105 | S | 3/2017 | Klus | |
| D789,180 | S | 6/2017 | Webb | |
| D789,181 | S | 6/2017 | Webb | |
| 9,766,045 | B2 | 9/2017 | Fultz | |
| 2002/0148178 | A1 | 10/2002 | Farag | |
| 2003/0126812 | A1 | 7/2003 | Folsom | |
| 2005/0166496 | A1 | 8/2005 | Farag | |
| 2008/0295425 | A1* | 12/2008 | Farag | E04B 2/90 52/235 |
| 2013/0008089 | A1 | 1/2013 | Mancebo | |
| 2016/0356077 | A1 | 12/2016 | Bou ri y | |

* cited by examiner

MULLING SYSTEM FOR A WINDOW ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

Aspects of the present disclosure are directed to a window assembly, and more particularly to a mulling system for a window assembly.

Description of the Related Art

Windows include window frames which are typically made from wood, metal, polymers, or a variety of combinations of these materials. A mullion, or mull, is commonly used to connect adjacent window frames together to form a window assembly. Although such a window assembly may enable a larger building opening to be filled by windows, the size and arrangement of a window assembly is limited because it must withstand wind loads and water infiltration (e.g., leaking) design requirements established by building codes, ordinances, and industry standards, such as those developed by the American Architectural Manufacturers Association (AAMA).

Traditionally, window frames are joined into an assembly in the field (e.g., field mulled) using an H-mull mulling system. The H-mull is typically formed of a vinyl or polymeric material and has a generally H-shaped cross-section defined by a central portion and lineals centered at either end. The H-mull is secured to the building and spans across the building opening, and adjacent window frames are positioned to abut the respective sides of the central portion of the H-mull. Screws are used to secure the adjacent window frames to one another through the mullion. Caulking or other sealant is often applied excessively to fill voids left between the H-mull and window frames in an attempt to prevent water from infiltrating the mullion and leaking into the adjacent building wall or interior space. Wood, metal, or plastic reinforcement may be attached to the central portion of the H-mull in order to increase the strength and rigidity of the window assembly. High-strength screws or other fasteners are then used to secure the outer perimeter of the window frames of the completed window assembly to the building opening.

These and other mulling systems known in the art are inadequate for several reasons. For example, mulling systems known in the art rely primarily on caulking to prevent water leakage, but improper field mulling, installation, and/or handling of the window assembly often breaks or deforms the caulk seal or mullion and enables water to infiltrate the mullion and leak into the adjacent building wall or interior space. The screws securing one window frame to another penetrate the H-mull, creating additional potential leak points that require sealing.

In addition, these mulling systems are commonly installed in the field where they offer the installer significant judgment regarding the type and placement of screws and caulking to use in forming the window assembly, which leads to inconsistent performance of each mulling system and necessitates costly and time consuming site testing of each window assembly. Further, these known mulling systems typically include a thin vinyl mullion with very little rigidity that often requires reinforcement to meet applicable wind load and other design requirements.

SUMMARY

Accordingly, there is a need for an improved mulling system for securing windows into a window assembly that is more resistant to water infiltration, while standardizing assembly and easily and economically meeting applicable design standards.

In accordance with one aspect of the invention, a window assembly is provided that includes a first window, a second window, and a mullion assembly interposed between and connected to the first and second windows. The mullion assembly includes a mullion core that is symmetrical about its horizontal and vertical axes. The mullion core includes a plurality (e.g., three, four) separate (e.g., isolated) compartments. The windows are coupled to the mullion core with fasteners that extend through different compartments in the mullion core to inhibit water leakage via the mullion assembly. Optionally, the mullion core has a pair of female latches on opposite sides of the mullion core that are configured to receive a corresponding catch of a cover, where the cover is configured to extend at least partially over the first and second windows when the catch is inserted into the latch on the mullion core. Optionally, the mullion core is monolithic (e.g., a single piece). Optionally, a structural sealant is provided between one or more surfaces of the mullion core and the first and second windows.

In accordance with another aspect, a mullion assembly for coupling adjacent windows is provided. The mullion assembly comprises a mullion core that is symmetrical about its horizontal and vertical axes. The mullion core includes a plurality (e.g., three, four) separate (e.g., isolated) compartments. The windows are coupled to the mullion core with fasteners that extend through different compartments in the mullion core to inhibit water leakage via the mullion assembly. Optionally, the mullion core has a pair of female latches on opposite sides of the mullion core that are configured to receive a corresponding catch of a cover, where the cover is configured to extend at least partially over the first and second windows when the catch is inserted into the latch on the mullion core. Optionally, the mullion core is monolithic (e.g., a single piece).

In accordance with one aspect of the invention, a window assembly is provided. The window assembly comprises a first window including a first window frame and a second window including a second window frame, wherein the second window is positioned adjacent the first window. The window assembly also comprises a mullion assembly connected to the first and second window frames. The mullion assembly comprises a mullion core disposed between the first and second window frames. The mullion core further comprises a single-piece (e.g., monolithic, continuous) construction. The mullion core also comprises a top (e.g., proximal) surface, wherein at least a portion of the top surface contacts a bottom (e.g., distal) portion of the first window frame. The mullion core further comprises a bottom (e.g., distal) surface, wherein at least a portion of the bottom surface contacts a top (e.g., proximal) portion of the second window frame. On a first end (e.g., side) of the mullion core, the mullion core also comprises a first female connector (e.g., latch or catch receptacle), and the mullion core further comprises a second female connector (e.g., latch or catch receptacle) on an opposite second end (e.g., side). The first female connector further comprises a first recessed area (e.g., opening) facing in a first direction and the second female connector further comprises a second recessed area (e.g., opening) facing in a second direction, wherein the first and second directions are opposite one another. The mullion core also comprises multiple separate segments (e.g., compartments or dry cavities) along its length, the segments being positioned vertically amid the top and bottom surfaces and horizontally (e.g., laterally) amid the first and second female connectors. The mullion core further comprises a first cover member (e.g., cap) of a single-piece (e.g., monolithic, continuous) construction and a second cover member of a single-piece construction. The first cover member comprises a first male connector (e.g., a catch) and a first pair of end projections (e.g., flanges), wherein the first male connector is configured to extend into the first recessed area to connect the first cover member to the first female connector such that the first pair of end projections cover and interface with an exterior (e.g., front) surface of the first and second window frames to seal the first end of the mullion core. The second cover member comprises a second male connector and a second pair of end projections, wherein the second male connector is configured to extend into the second recessed area to connect the second cover member to the second female connector such that the second pair of end projections cover and interface with an interior (e.g., rear) surface of the first and second window frames to seal the second end of the mullion core. The window assembly also comprises structural seals positioned amid a lateral (e.g., horizontal) portion of the top surface of the mullion core and the bottom portion of the first window frame, amid a lateral portion of the bottom surface of the mullion core and the top portion of the second window frame, and amid the first cover member and the first and second window frames to seal the mullion assembly against the first and second window frames to inhibit water infiltration (e.g., leakage, penetration) from an exterior (e.g., front facing) side of the first and second windows to an interior (e.g., rear facing) side of the first and second windows such that water infiltration is inhibited during use.

In accordance with another aspect, a mullion core assembly is provided. The mullion core assembly comprises a body of single-piece (e.g., monolithic, continuous) construction having a top (e.g., proximal) surface and a bottom (e.g., distal) surface, the body configured to be positioned amid and connected to first and second window frames. The body further comprises a first female connector (e.g., latch or catch receptacle) on a first end (e.g., side) and the body, and a second female connector (e.g., latch or catch receptacle) on an opposite second end (e.g., side) of the body. The first female connector further comprises a first recessed area (e.g., opening) facing in a first direction and the second female connector further comprises a second recessed area (e.g., opening) facing in a second direction, wherein the first and second directions are opposite one another. The body also comprises multiple separate segments (e.g., compartments or dry cavities) along its length, the segments being positioned vertically amid the top and bottom surfaces and horizontally (e.g., laterally) amid the first and second female connectors. The first and second female connectors of the mullion assembly are further configured to connect to a pair of cover members (e.g., caps), the cover members having a male connector connectable with (e.g., insertable into) the first and second recessed areas and a pair of end projections (e.g., flanges) configured to cover and interface with a surface of the first and second window frames located at either end of the body such that a seal is formed amid and against the first and second window frames.

In accordance with another aspect of the invention, a method of manufacturing a window assembly is provided. The method comprises providing a mullion core comprising a monolithic body symmetric about a central vertical axis and about a central horizontal axis, the body having a proximal surface and a distal surface, a first latch defined on a first side of the body and having a first latch opening facing in a first direction, a second latch defined on an opposite second side of the body and having a second latch opening facing in a second direction opposite the first direction, and a plurality of separate compartments defined along a length of the monolithic body vertically between the proximal and distal surfaces and laterally between the first and second latches. The method also comprises arranging the mullion core relative to a first window frame and a second window frame so that the mullion core is interposed between the first and second window frames. The method also comprises fastening the mullion core to the first and second window frames with one or more fasteners arranged in separate fastener rows, each fastener row extending through a separate compartment of the mullion core. The method also comprises fastening a first monolithic cap to the mullion core so that a first male catch of the first monolithic cap extends into the first latch opening to couple the first monolithic cap to the first latch so that a pair of flanges of the first monolithic cap extend over and contact a front surface of the first and second window frames to seal the first side of the mullion core. The method also comprises fastening a second monolithic cap to the mullion core so that a second male catch of the second monolithic cap extends into the second latch opening to couple the second monolithic cap to the second latch so that a pair of flanges of the second monolithic cap extend over and contact a rear surface of the first and second window frames to seal the second side of the mullion core.

DETAILED DESCRIPTION

Figure 1:
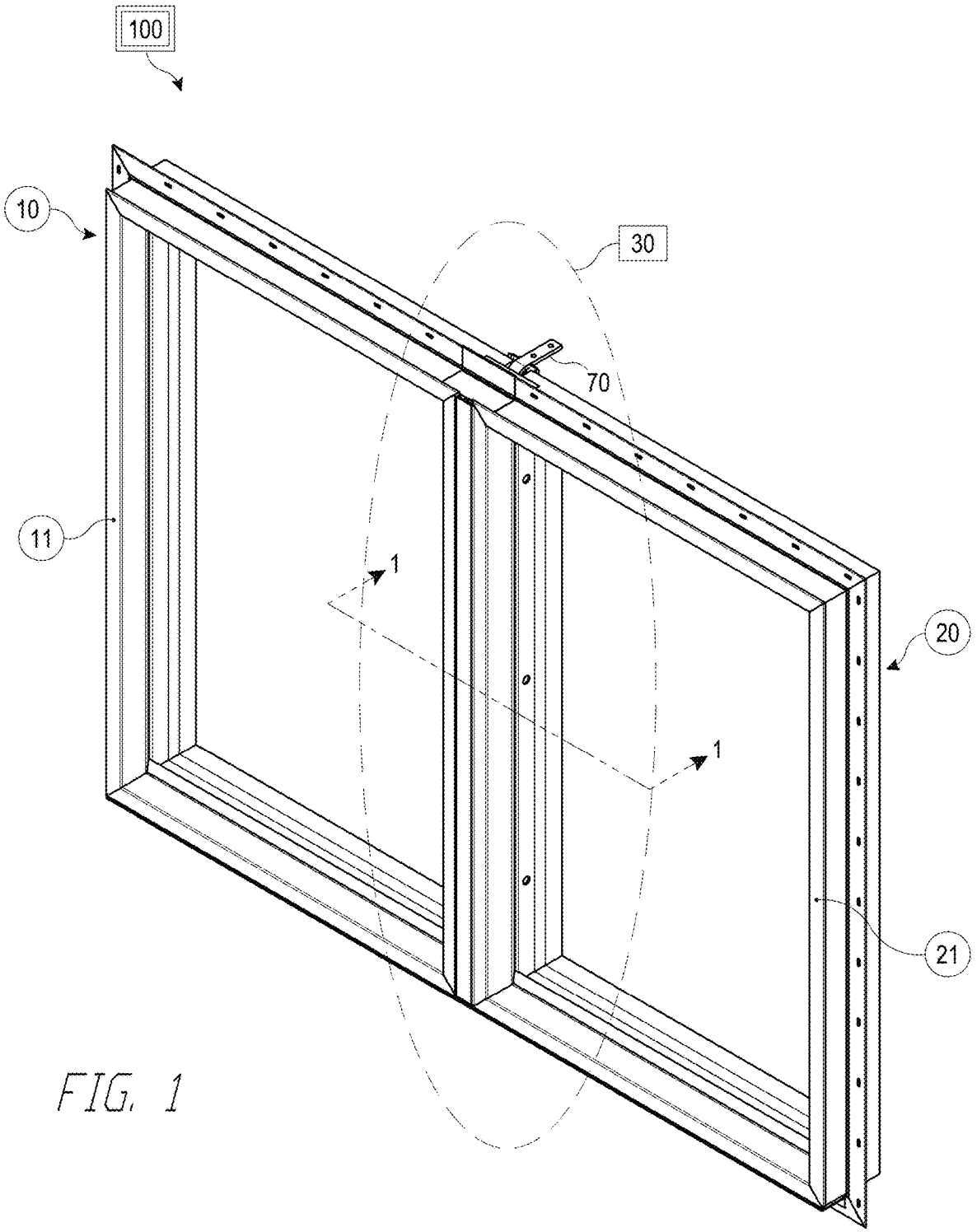
FIG. 1 is a perspective view of one embodiment of a window assembly with a mullion assembly.
Figure 2:
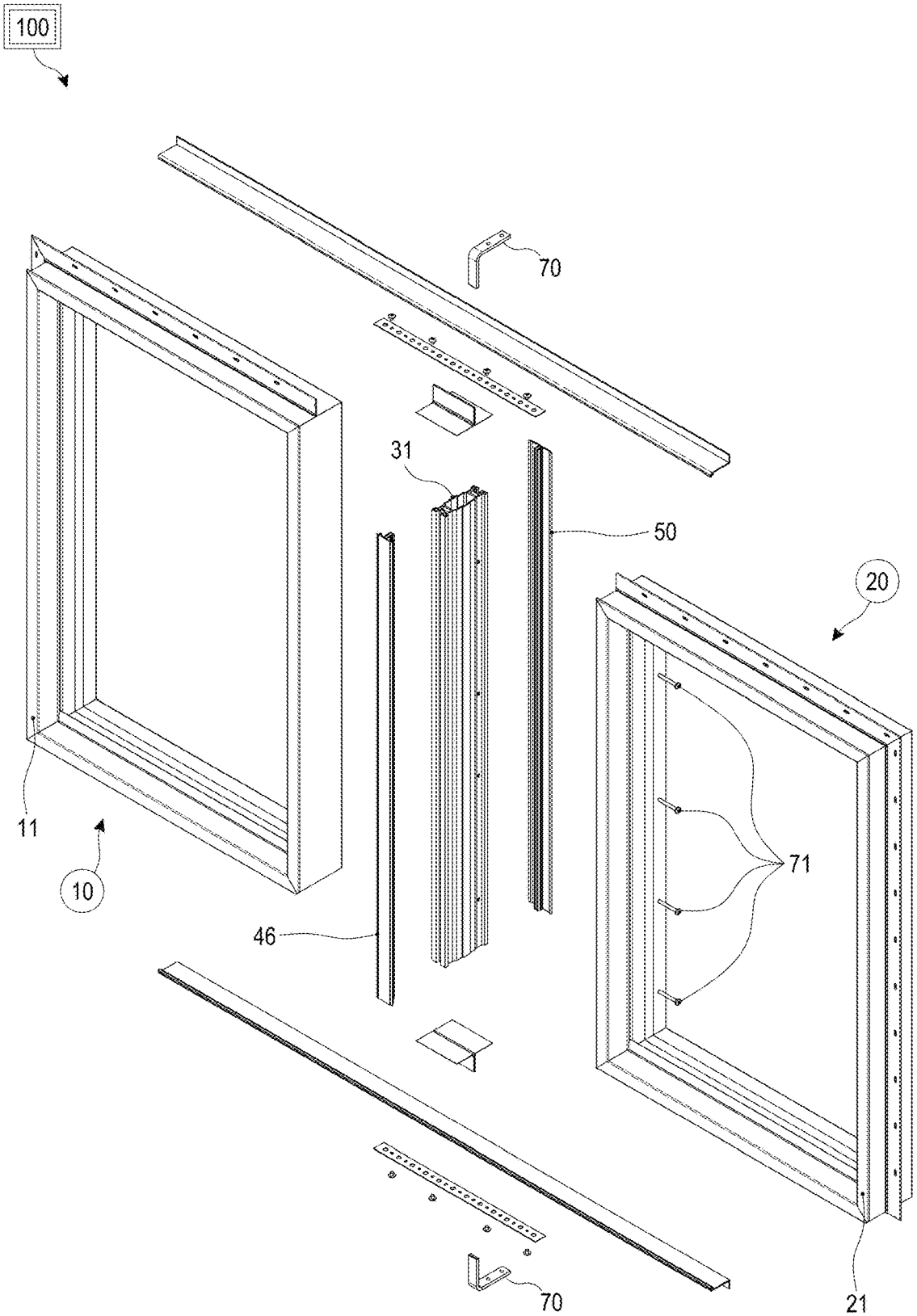
FIG. 2 is an exploded view of the window assembly with the mullion assembly.
Figure 3:
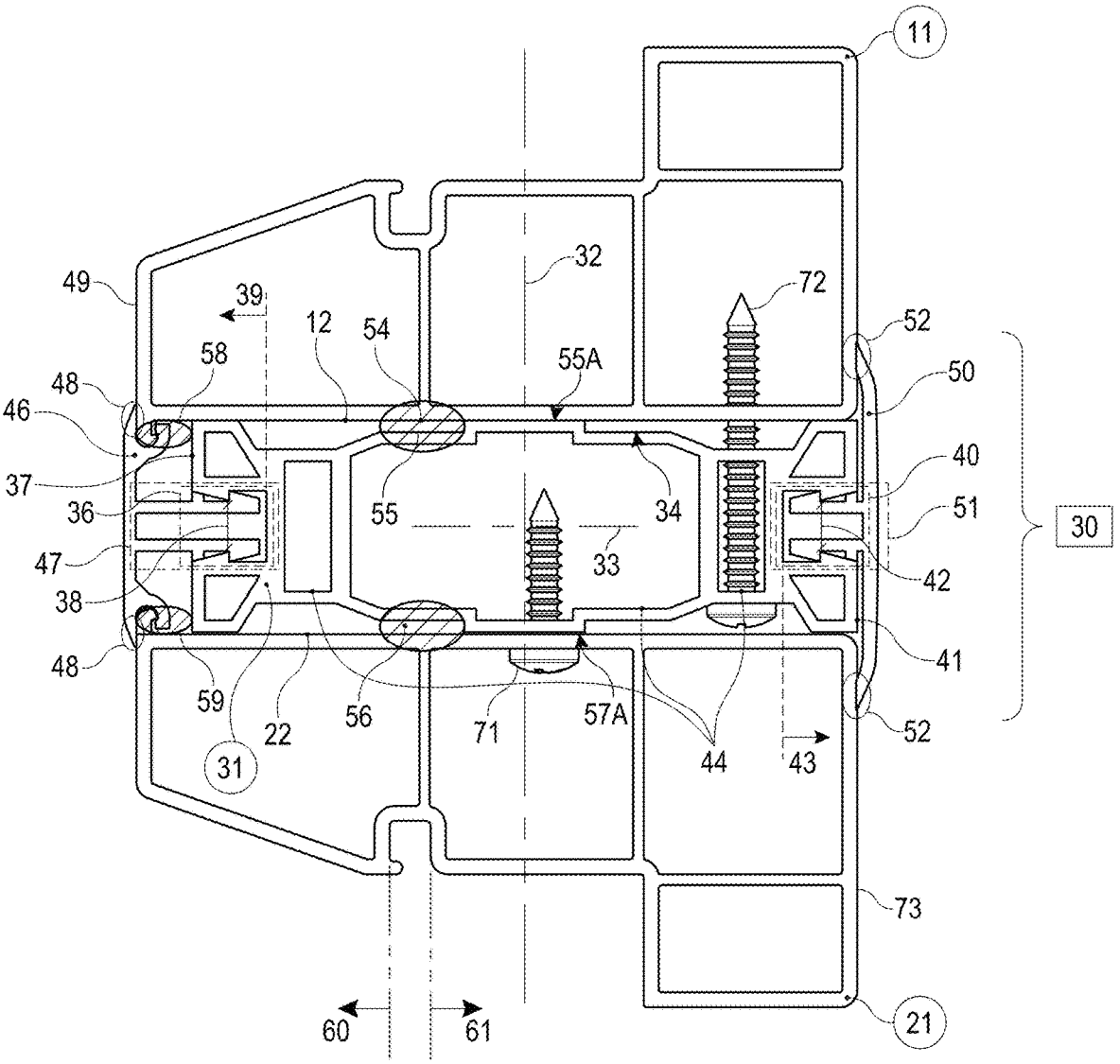
FIG. 3 is a cross-sectional view of the window assembly with the mullion assembly, as taken along section line 1-1 in FIG. 1.
Figure 4:
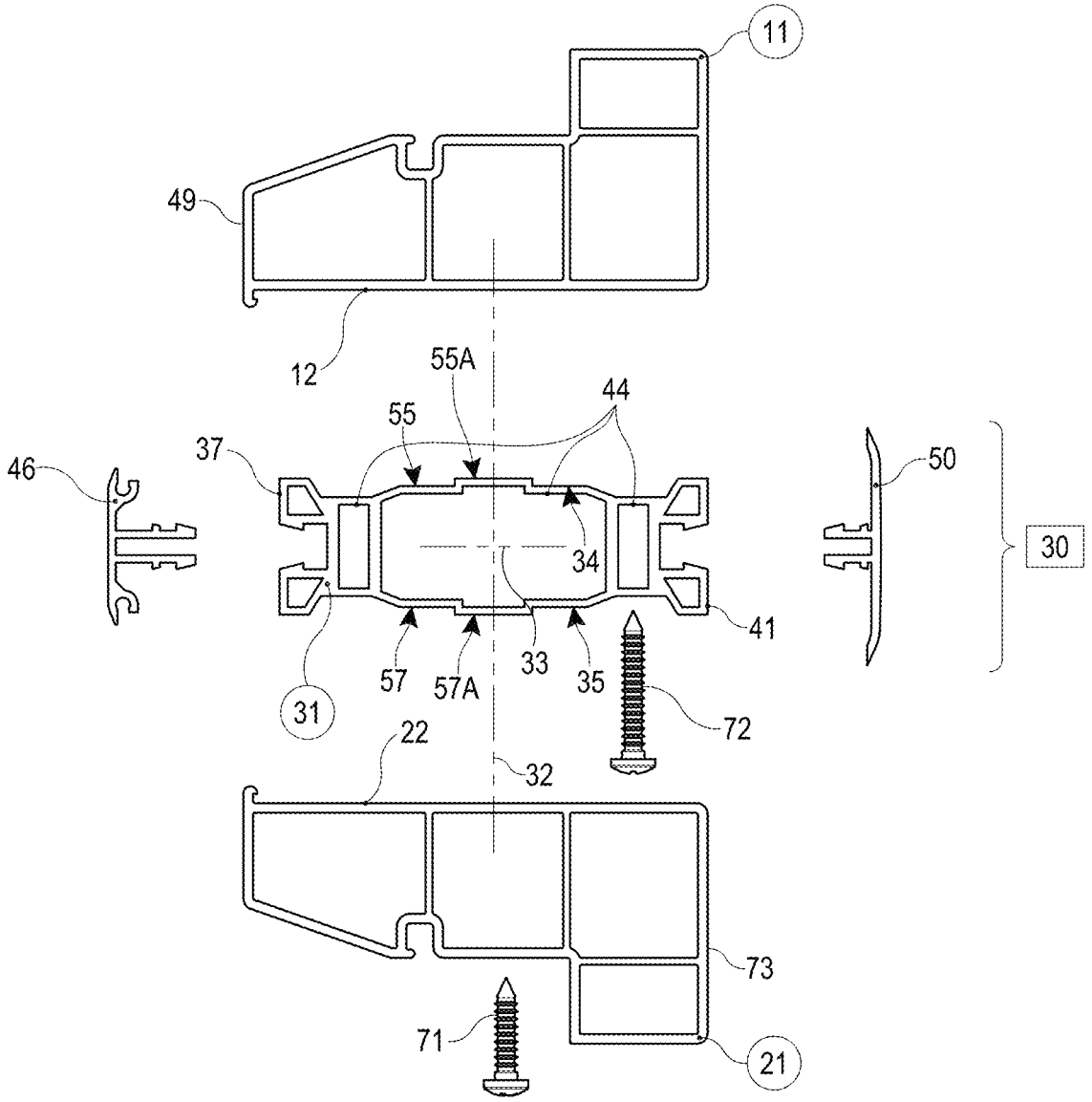
FIG. 4 is an exploded view of the cross-sectional view of the window assembly with the mullion assembly.
Figure 5:
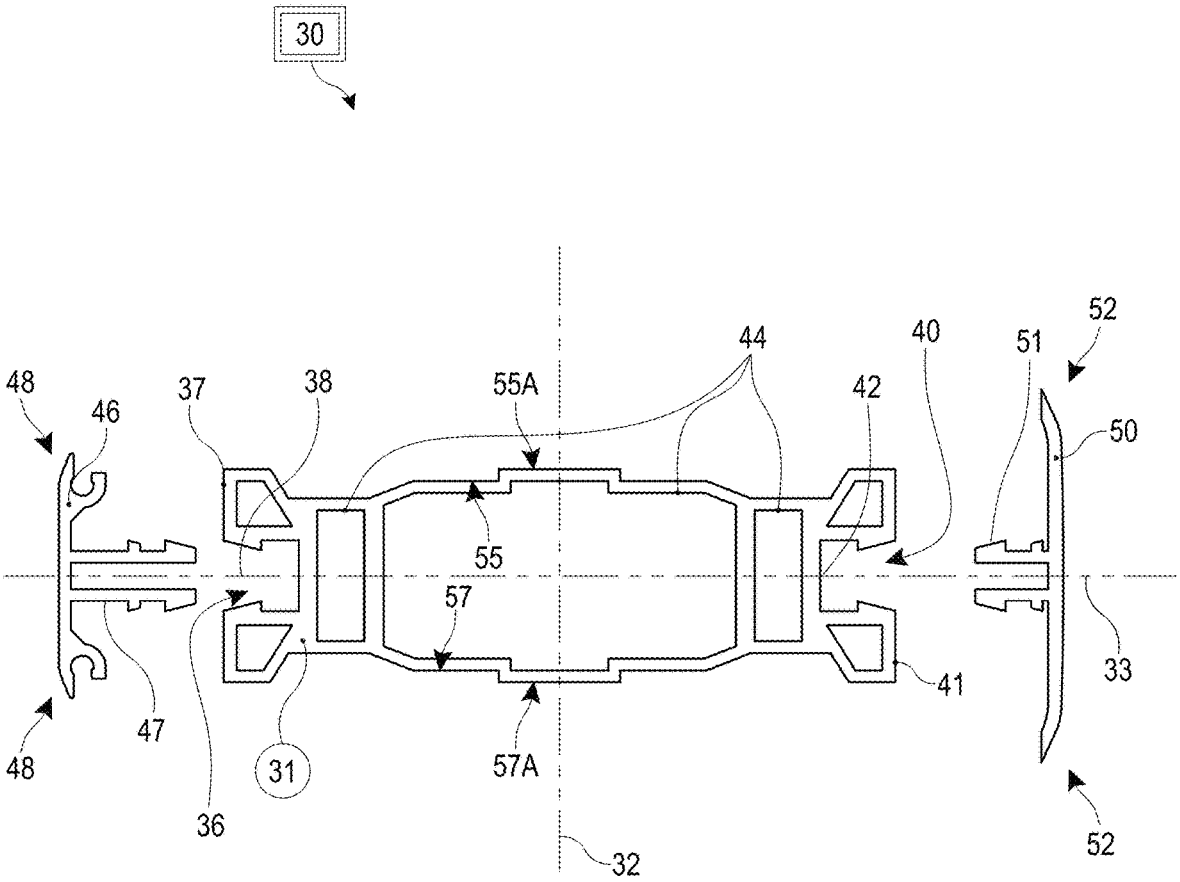
FIG. 5 is a cross-sectional view of the window assembly with the mullion assembly, similar to that shown in FIG. 3, but without window frames.
Figure 6:
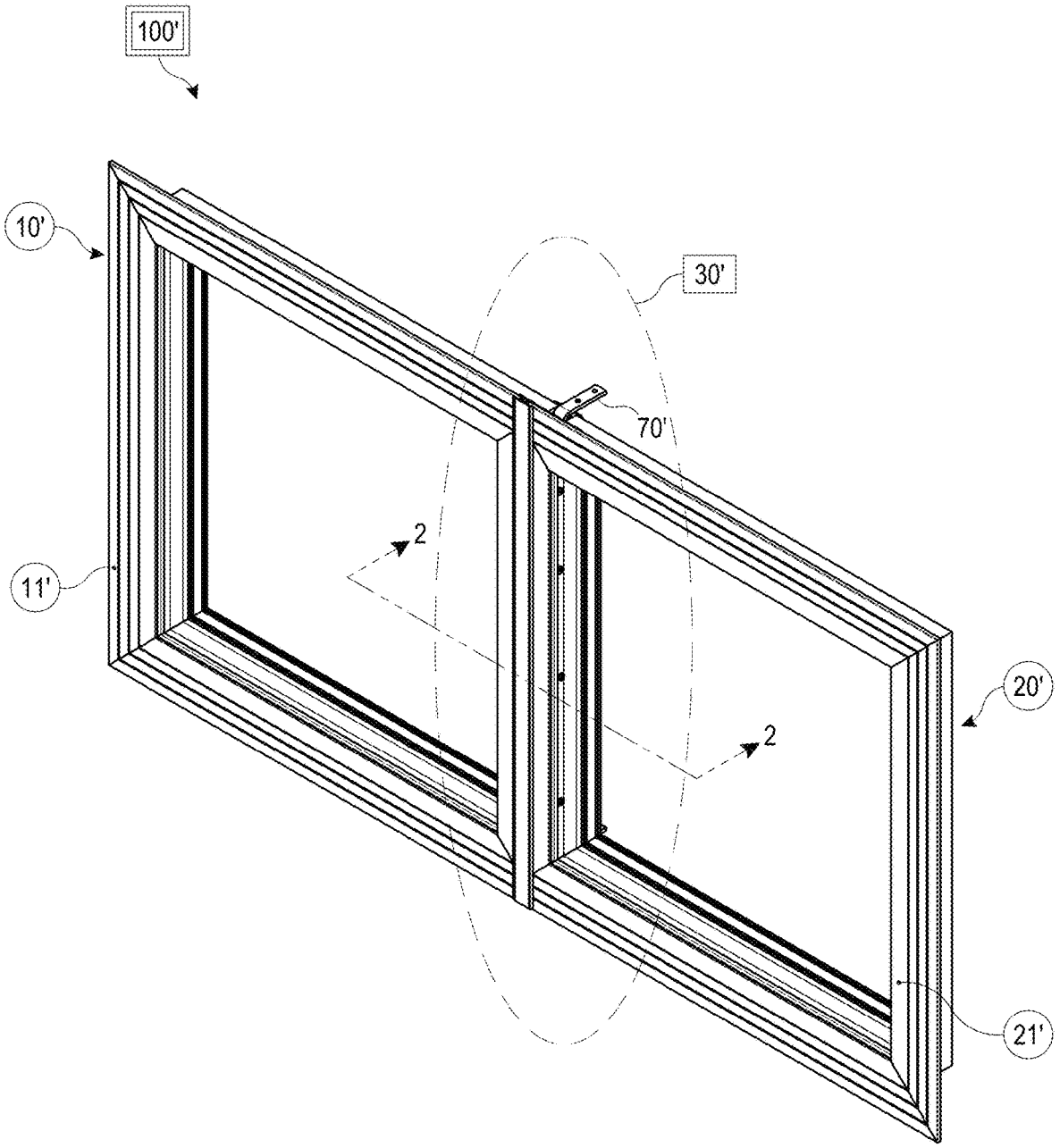
FIG. 6 is a perspective view of another window assembly with a mullion assembly.
Figure 7:
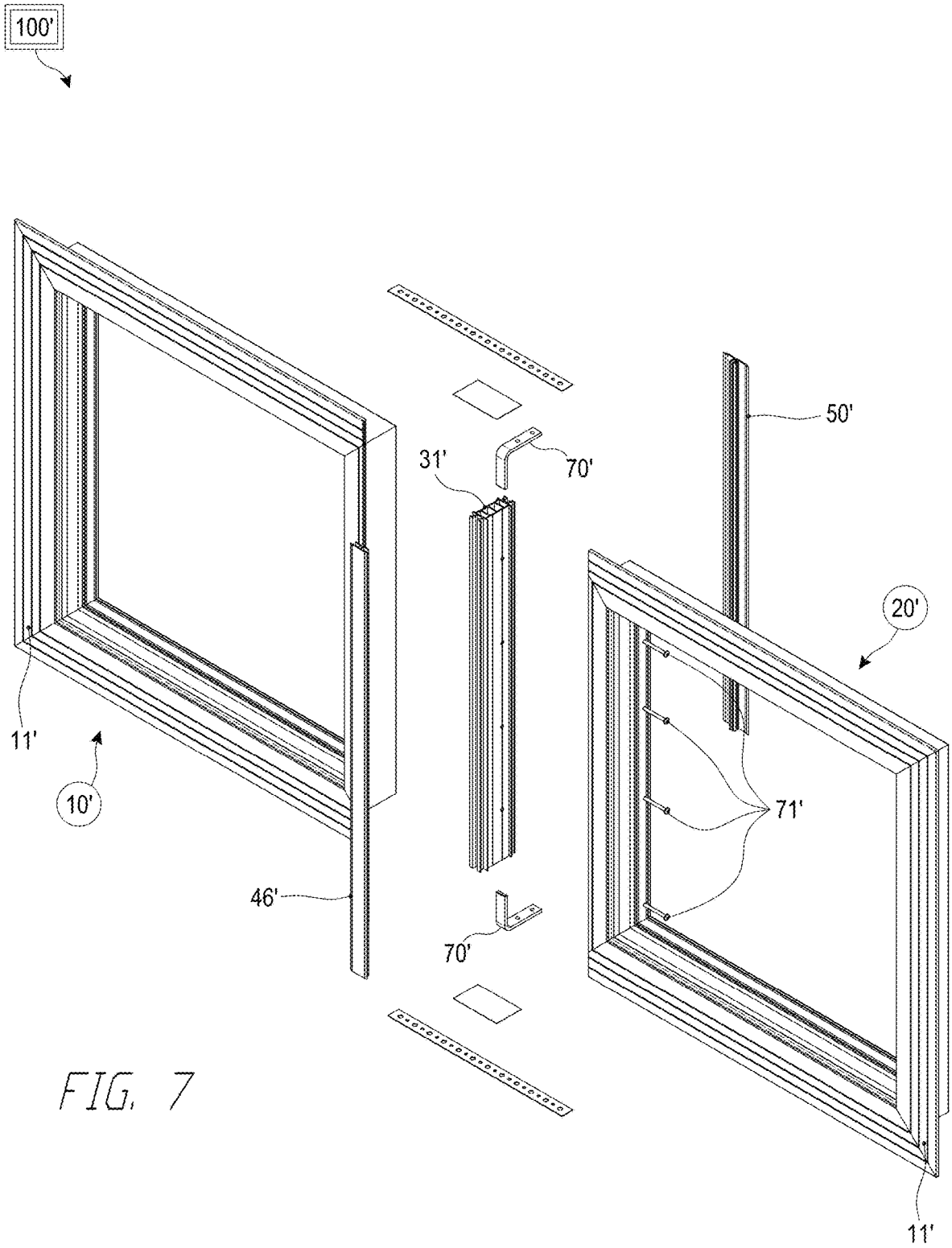
FIG. 7 is an exploded view of the window assembly of FIG. 6 with the mullion assembly.
Figure 8:
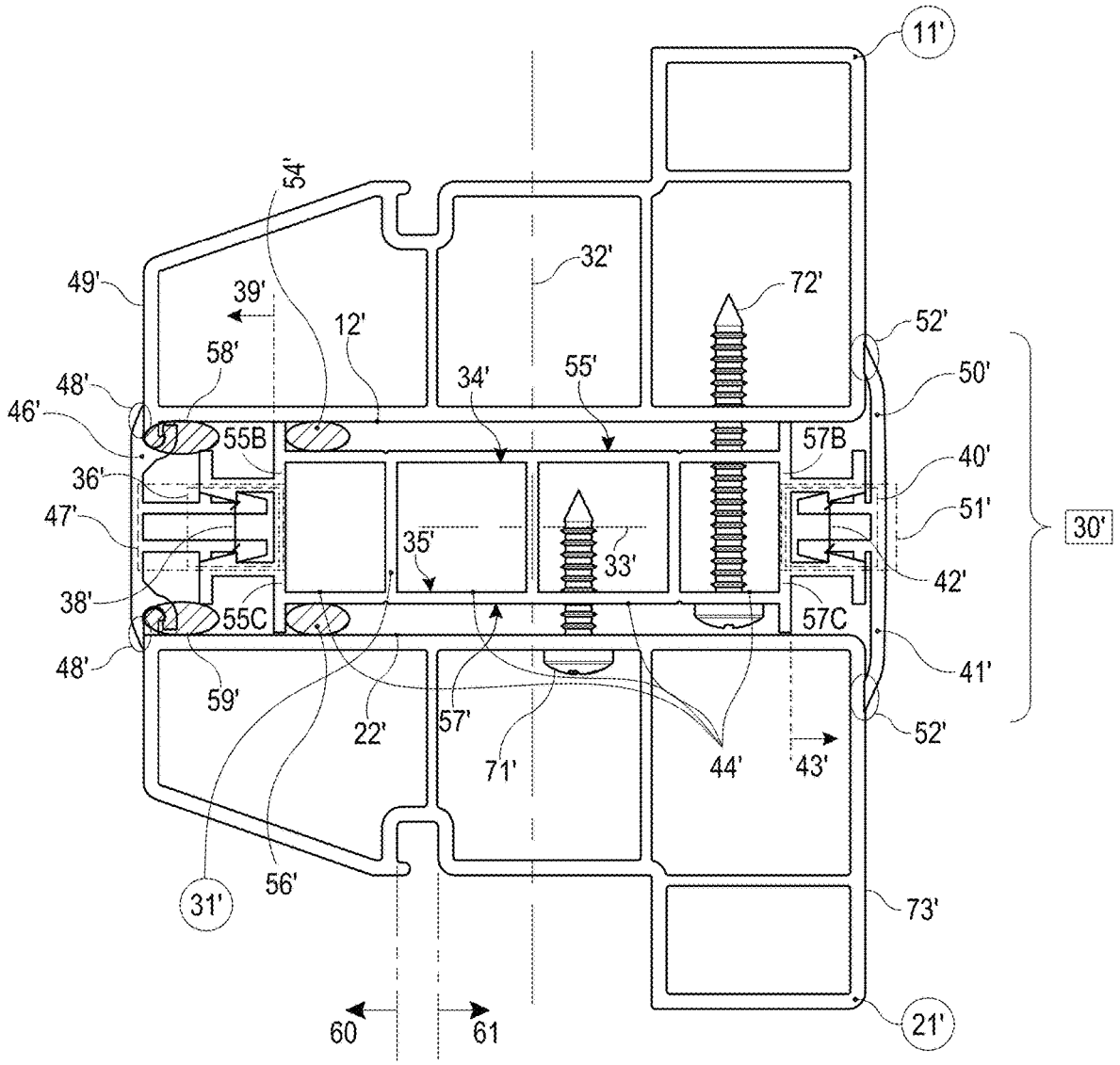
FIG. 8 is a cross-sectional view of the window assembly with the mullion assembly, as taken along section line 2-2 in FIG. 6.
Figure 9:
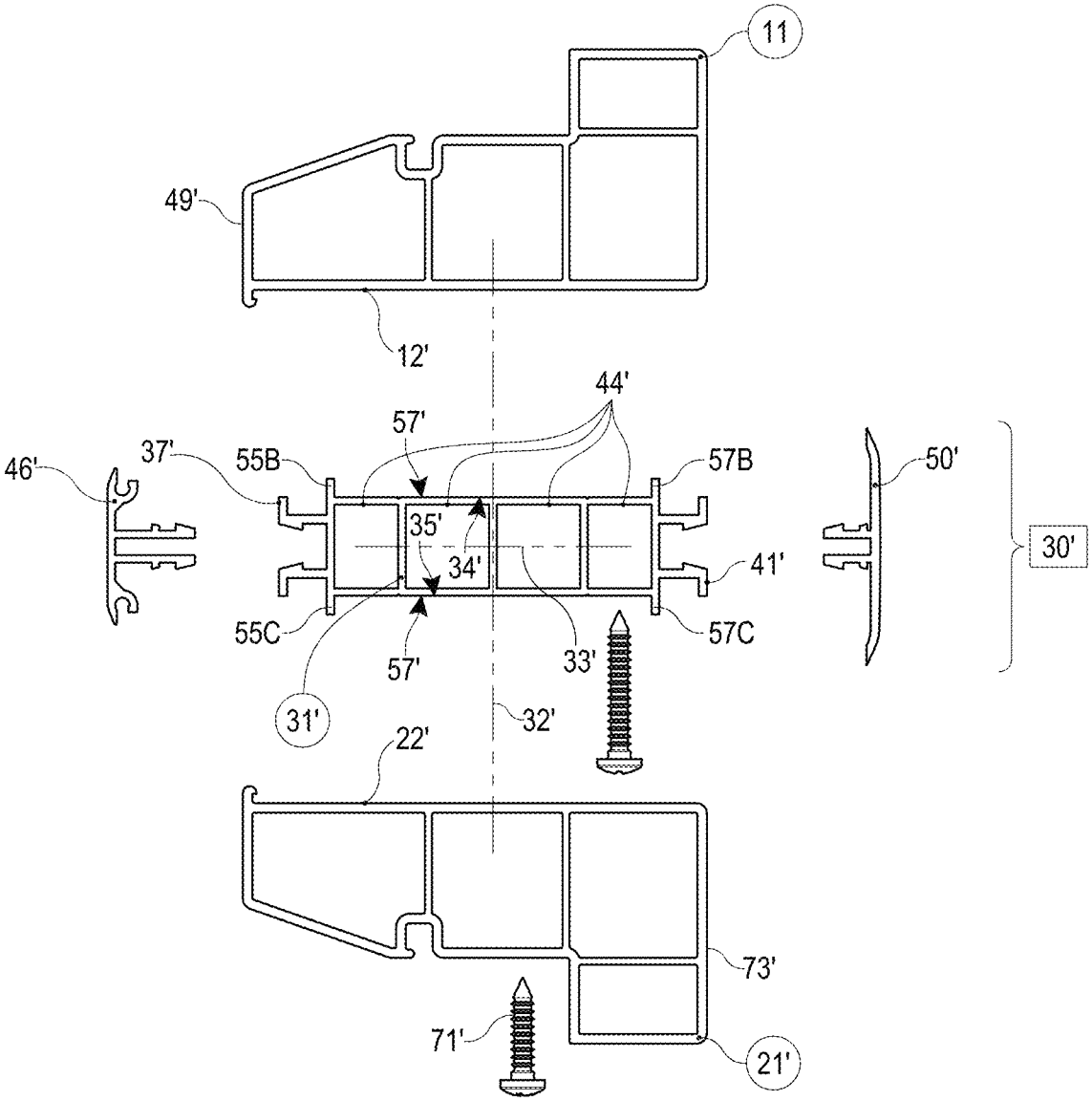
FIG. 9 is an exploded view of the cross-sectional view of the window assembly with the mullion assembly.
Figure 10:
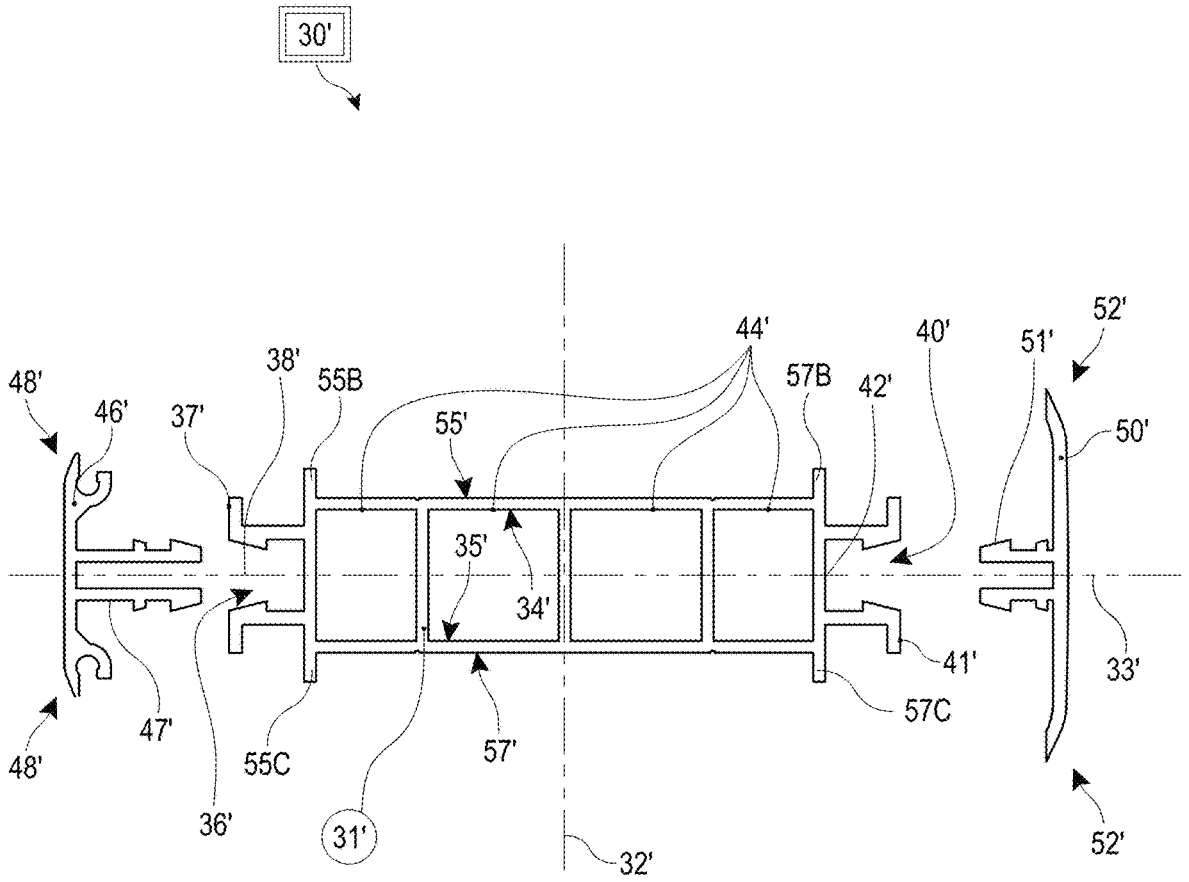
FIG. 10 is a cross-sectional view of the window assembly with the mullion assembly, similar to that shown in FIG. 8, but without window frames.

FIGS. 1-5 show a window assembly 100 with a mullion assembly 30 for use in securing a first window 10 and a second window 20 into the window assembly 100 that may be structurally connected to a building opening and meet applicable wind load and other design requirements, for example to inhibit water from leaking from front facing side 60 of the window assembly 100 to a rear facing side 61 (see FIG. 3). Though described in connection with a window assembly 100 that is structurally connected to a building opening, the window assembly 100 can be used in other structures or devices (e.g., vehicles, boats) where a water leak-inhibiting connection between two or more window frames is required.

The window assembly 100 can have a first window 10 with a first window frame 11 having a distal portion 12, a second window 20 with a second window frame 21 having a proximal portion 22, and a mullion assembly 30 connecting the first and second window frames 11, 21 and interposed between the first and second window frames 11, 21. The mullion assembly 30 can optionally contact at least a portion of the distal portion 12 and the proximal portion 22. The first and second window frames 11, 21 include a front surface 49 (see FIG. 3) which faces the exterior of the building when the window assembly 100 is installed in the building opening. The second window frame 21 connects to the mullion assembly 30 via fasteners (e.g., screws or bolts, as shown in FIG. 3) 71 that extend through the second window frame 21 into a mullion core 31 of the mullion assembly 30 (e.g., optionally extend through holes in the second window frame 21). The first window frame 11 connects to the mullion assembly 30 via fasteners (e.g., screws or bolts, as shown in FIG. 3) 72 that extend through the first window frame 11 into the mullion core 31 (e.g., optionally extend through holes in the first window frame 11). The first and second window frames 11, 21 may optionally be coupled to the mullion core 31 using TEK or other self-tapping screws, or through pre-drilled holes using high-strength (e.g., sheet metal, steel, or other metal alloy) screws or bolts. However, other suitable mechanisms can be used to couple the first and second window frames 11, 21 to the mullion core 31. For example, the first and second window frames 11, 21 can connect to the mullion core 31 via barbs, a press-fit connection, a snap-fit connection, mechanical interlock, friction fit, or other suitable attachment mechanism. Optionally, a single fastener 71 or 72 may couple both of the first and second window frames 11, 21 to the mullion core 31 in lieu of the use of two fasteners 71, 72.

The mullion core 31 can include a proximal side 34, a distal side 35, a first side 37, and a second side 41 (see FIG. 3), where the first and second sides 37, 41 face in opposite directions and the proximal and distal sides 34, 35 face in opposite directions. The proximal side 34 includes a horizontal surface 55 and a stepped portion 55A. The distal side 35 includes a horizontal surface 57 and a stepped portion 57A. In forming a window assembly 100, at least a portion of the distal portion 12 of the first window frame 11 may contact the stepped portion 55A of the mullion core 31, and at least a portion of the proximal portion 22 of the second window frame 21 may contact the stepped portion 57A of the mullion core 31. Optionally, the mullion core 31 can be symmetric about both a central vertical axis 32 and a central horizontal axis 33 (see FIG. 3), thereby advantageously facilitating the assembly of the window assembly 100 and inhibiting errors in assembly.

Advantageously, the mullion core 31 includes a plurality of separate segments (e.g., compartments or dry cavities) 44 positioned laterally between the first and second sides 37, 41 and vertically between the proximal and distal sides 34, 35 of the mullion core 31 (see FIGS. 3-5), such that the fastener entry points (e.g., holes) of fasteners 71, 72 into the mullion core 31 may be isolated into different respective segments 44. By isolating the fasteners 71, 72 into separate respective segments 44, any water which leaks through a fastener entry point is advantageously confined to the relevant segment 44 and inhibited from leaking further toward the rear facing side 61 of the window assembly 100. The mullion core 31 shown in FIGS. 3-5 has three segments 44. However, the mullion core 31 can have fewer (e.g., two) or more (e.g., four) segments 44.

The first and second sides 37, 41 of the mullion core 31 can optionally be perpendicular to the proximal and distal sides 34, 35 of the mullion core 31 (see FIG. 3). Alternatively, the first and second sides 37, 41 may also be angled (e.g., at other than 90 degrees) relative to the proximal and distal sides 34, 35. The first side 37 may include a first female connector (e.g., a latch or catch receptacle) 36, and the second side 41 may include a second female connector (e.g., a latch or catch receptacle) 40. The first and second female connectors 36, 40 include first and second recessed areas (e.g., openings) 38, 42 that extend toward the central vertical axis 32 of the mullion core 31, such that the recessed areas 38, 42 may face in opposite directions.

The mullion assembly 30 optionally includes first and second cover members (e.g., caps) 46, 50 (see FIGS. 2-5) to cover the gaps (e.g., the space occupied by the mullion assembly 30) between the first and second window frames 11, 21 on a front facing side 60 and a rear facing side 61 of the window assembly 100. The first cover member 46 includes a first male connector (e.g., a catch) 47 and a first pair of end projections (e.g., flanges) 48. The first male connector 47 may extend into the first female connector 36 until the first male connector 47 is secured in the first recessed area 38 of the first female connector 36 via a snap-fit, friction fit, mechanical interlock, or other suitable mechanical engagement of the first male connector 47 with the first recessed area 38. With the first male connector 47 connected to the first female connector 36, the first pair of end projections 48 of the first cover member 46 cover and interface with the front surface 49 of the first and second window frames 11, 21 (see FIG. 3) to seal the first side 37 of the mullion core 31.

The second cover member 50 optionally includes a second male connector (e.g., a catch) 51 and a second pair of end projections (e.g., flanges) 52. The second male connector 51 may extend into the second female connector 40 until the second male connector 51 is secured in the second recessed area 42 of the second female connector 40 via a snap-fit, friction fit, mechanical interlock, or other suitable mechanical engagement of the second male connector 51 with the second recessed area 42. With the second male connector 51 connected to the second female connector 40, the second pair of end projections 52 of the second cover member 50 cover and interface with the rear surface 73 of the first and second window frames 11, 21 (see FIG. 3) to seal the second side 41 of the mullion core 31. The first and second male connectors 47, 51 of the first and second cover members 46, 50 may be identically, similarly, or differently sized. For example, the depth of the first male connector 47 may be greater than or equal to the depth of the second male connector 51.

One or more structural seals (e.g., caulk, sealant, or foam) may optionally be included within the mullion assembly 30 to inhibit water from infiltrating the mullion assembly 30. For example, a structural seal 54 may be positioned amid the distal portion 12 of the first window frame 11 and the horizontal surface 55 of the proximal side 34 of the mullion core 31 (e.g., between the distal portion 12 and the proximal side 34 at a location between the stepped portion 55A and the first side 37). Another structural seal 56 may optionally be positioned amid the proximal portion 22 of the second window frame 21 and the horizontal surface 57 of the distal side 35 of the mullion core 31 (e.g., between the proximal portion 22 and the distal side 35 at a location between the stepped portion 57A and the first side 37). Additional structural seals 58, 59 may optionally be positioned amid the first cover member 46 and the first and second window frames 11, 21. Use of one or more of the structural seals 54 and 56 or 58 and 59 seals the mullion assembly 30 against the distal portion 12 of the first window frame 11 and the proximal portion 22 of the second window frame 21 to inhibit water leakage from a front facing side 60 of the window assembly 100 to a rear facing side 61.

FIGS. 6-10 illustrate another window assembly 100'. The window assembly 100' can have a mullion assembly 30' and is constructed in a similar way to the window assembly 100 shown in FIGS. 1-5, except as noted below. Thus, the reference numerals used to designate the various components of the window assembly 100' are identical to those used for identifying the corresponding components of the window assembly 100 in FIGS. 1-5, except that a "'" has been added to the reference numerals of FIGS. 6-10.

The window assembly 100' can have a mullion assembly 30' interposed between the first and second window frames 11', 21' and connecting the first and second window frames 11', 21'. In forming the window assembly 100', the mullion assembly 30' can optionally contact at least a portion of the distal portion 12' of the first window frame 11' and the proximal portion 22' of the second window frame 21'. The first and second window frames 11', 21' connect to the mullion assembly 30' via fasteners 72' that extend through the first window frame 11' into the mullion core 31' (see FIG. 8), and via fasteners 71' that extend through the second window frame 21' into the mullion core 31'. The first and second window frames 11', 21' may optionally be coupled to the mullion core 31' using TEK or other self-tapping screws, or through pre-drilled holes using high-strength (e.g., sheet metal, steel, or other metal alloy) screws or bolts. Other suitable mechanisms, however, can be used to couple the first and second window frames 11', 21' to the mullion core 31'. For example, the first and second window frames 11', 21' can connect to the mullion core 31' via barbs, a press-fit connection, a snap-fit connection, mechanical interlock, friction fit, or other suitable attachment mechanism. Optionally, a single fastener 71' or 72' may couple both of the first and second window frames 11', 21' to the mullion core 31' in lieu of the use of two fasteners 71', 72'.

The mullion assembly 30' can include a mullion core 31' having a proximal side 34', a distal side 35', a first side 37', and a second side 41' (see FIG. 8), where the first and second sides 37', 41' face in opposite directions and the proximal and distal sides 34', 35' face in opposite directions. Optionally, the proximal side 34' includes a horizontal surface 55' and the distal side 35' optionally includes a horizontal surface 57'. The horizontal surfaces 55', 57' can be parallel relative to one another or parallel relative to a central horizontal axis 33'. In addition, the mullion core 31' can optionally be symmetric about both a central vertical axis 32' and the central horizontal axis 33'.

The mullion core 31' can optionally include a first pair of core flanges 55B, 55C between the first female connector 36' and the horizontal surfaces 55', 57' (see FIG. 8), and a second pair of core flanges 57B, 57C between the second female connector 40' and the horizontal surfaces 55', 57'. Alternatively, the first pair of core flanges 55B, 55C and the second pair of core flanges 57B, 57C may be included closer toward the central vertical axis 32' on the horizontal surfaces 55', 57'. The first pair of core flanges 55B, 55C and the second pair of core flanges 57B, 57C may include first and second proximal core flanges 55B, 57B which extend from the proximal side 34' of the mullion core 31' and first and second distal core flanges 55C, 57C which extend from the distal side 35'. Optionally, the first and second proximal core flanges 55B, 57B extend perpendicular to and away from the central horizontal axis 33' and the first and second distal core flanges 55C, 57C extend in the opposite direction and away from the central horizontal axis 33'. Advantageously, the first pair of core flanges 55B, 55C may separate the horizontal surfaces 55', 57' from the first female connector 36' (see FIG. 8), and the second pair of core flanges 57B, 57C may separate the horizontal surfaces 55', 57' from the second female connector 40'. Accordingly, in forming a window assembly 100', at least a portion of the distal portion 12' of the first window frame 11' may contact the first and second proximal core flanges 55B, 57B (see FIG. 8), and at least a portion of the proximal portion 22' of the second window frame 21' may contact the first and second distal core flanges 55C, 57C.

Advantageously, the mullion core 31' includes a plurality of separate segments 44' positioned laterally between the first and second sides 37', 41' and vertically between the proximal and distal sides 34', 35' of the mullion core 31' (see FIGS. 8-10), such that fastener entry points (e.g., holes) of fasteners 71', 72' into the mullion core 31' may be isolated into different respective segments 44'. The mullion core 31' shown in FIGS. 8-10 has four segments 44'. However, the mullion core 31' can have fewer (e.g., three) or more (e.g., five) segments 44'.

One or more structural seals may be included within the mullion assembly 30' to inhibit water from infiltrating the mullion assembly 30'. For example, structural seals 58', 59' may be positioned amid the first cover member 46' and the first and second window frames 11', 21'. Optionally, a structural seal 54' may abut the first proximal core flange 55B on the side of the flange 55B facing the central vertical axis 32' (see FIG. 8), and may be positioned amid the distal portion 12' of the first window frame 11' and the horizontal surface 55' of the proximal side 34' of the mullion core 31'. Another structural seal 56' may optionally abut the first distal core flange 55C on the side of the flange 55C facing the central vertical axis 32', and may be positioned amid the proximal portion 22' of the second window frame 21' and the horizontal surface 57' of the distal side 35' of the mullion core 31'. Use of one or more of the structural seals 54' and 56' or 58' and 59' seals the mullion assembly 30' against the distal portion 12' of the first window frame 11' and the proximal portion 22' of the second window frame 21' to inhibit water leakage from a front facing side 60' of the window assembly 100' to a rear facing side 61'.

The mullion core 31, 31' may optionally be a single piece (e.g., monolithic, continuous) that is made from a structural aluminum, steel, wood, polymer or other material rigid enough to connect multiple window frames into an assembly that satisfies applicable wind load design requirements and other design standards. Additionally, the first cover member 46, 46' and the second cover member 50, 50' can optionally be made of the same material as the mullion core 31, 31'. Optionally, the first cover member 46, 46' and the second cover member 50, 50' can be made of a different material than the mullion core 31, 31'.

The cross-section of the mullion core 31, 31' may optionally have a depth along the central horizontal axis 33, 33' between about 1.50 and 5.00 inches and a height along the central vertical axis 32, 32' between about 0.50 and 2.00 inches. However, the mullion core 31, 31' may have smaller or larger depths and heights as is required by a particular design scenario. Additionally, the proximal and distal sides 34, 35 of the mullion core 31 and the proximal and distal sides 34', 35' of the mullion core 31' may optionally have a wall thickness between 0.030 and 0.125 inches, although smaller and larger wall thicknesses may be used as is required by a particular design scenario. Each of the plurality of separate segments 44, 44' of the mullion core 31, 31' may optionally have different depths and heights, although two or more of the plurality of separate segments 44, 44' may have the same depth and height. Optionally, the plurality of separate segments 44, 44' may have a depth along the central horizontal axis 33, 33' between 0.125 and 2.50 inches, and a height along the central vertical axis 32, 32' between 0.50 and 2.00 inches, although the plurality of separate segments 44, 44' may have larger or smaller depths and heights as is required by a particular design scenario.

In operation, the completed window assembly 100, 100' may be assembled at the factory and delivered to the construction site, where it can optionally be secured to a building opening using brackets 70, 70' (see FIGS. 1-3, 6-8) that are connected to the exposed ends of the mullion core 31, 31'. Brackets 70, 70' may include a first portion which can be inserted into and secured within one of the plurality of separate segments 44, 44' and a second portion which can be structurally connected to a structural member or connection point of the building opening. For example, the second portion of the brackets 70, 70' may include holes or slots to allow fasteners (e.g., screws, bolts, rivets, or nails) to be inserted and secure the brackets 70, 70' to the building opening. The brackets 70, 70' may be formed of any structural grade aluminum, steel, polymer, or other suitable metal alloy or material. Optionally, the first and second portions of the brackets 70, 70' may be positioned substantially perpendicular to one another. Additionally, the first and second portions of the brackets 70, 70' may have different thicknesses or dimensions as is appropriate for the specific design scenario.

Use of the full combination of structural seals 54, 56, 58, 59 (see FIG. 3) or the full combination of structural seals 54', 56', 58', 59' (see FIG. 8) is not necessary to inhibit water leakage. Use of either full combination of structural seals, however, along with the first cover member 46, 46' creates a three-point redundancy to inhibit water leakage. For example, within the mullion assembly 30, the first cover member 46, the structural seals 58, 59, and structural seals 54, 56 may act as three discrete, successive water barriers to inhibit water from infiltrating to the rear facing side 61 of the window assembly 100. Similarly, within the mullion assembly 30', the first cover member 46', the structural seals 58', 59', and structural seals 54', 56' may act as three discrete, successive water barriers to inhibit water from infiltrating to the rear facing side 61' of the window assembly 100'. The window assemblies 100, 100' formed using the respective mullion assemblies 30, 30' can advantageously achieve a rating of at least Performance Grade (PG) 75 (e.g., PG 75, PG 100) based on the AAMA 101 standard.

Advantageously, in addition to its ability to inhibit water leakage, the window assembly 100, 100' formed using the respective mullion assembly 30, 30' is much stronger and more rigid than traditional window assemblies. The increased strength and rigidity of the window assembly 100, 100' may allow for the window assembly 100, 100' to incorporate more window frames or larger window frames, such that larger building openings may be filled by windows than traditional window assemblies would allow (e.g., enabling more natural lighting to enter the adjacent building), while still meeting applicable wind load design requirements and other standards. The window assemblies 100, 100' formed using the respective mullion assemblies 30, 30' can advantageously achieve a design pressure rating of DP-50 based on the AAMA 101 standard.

In addition, the window assembly 100, 100' having the respective mullion assembly 30, 30' may be completed within a factory, such that traditional field mulling is no longer required. As a result, after submitting designs or requirements for a window assembly 100, 100' to the manufacturer, the manufacturer can produce and supply the completed window assembly 100, 100' for installation into building openings of a building. Factory mulling the window assembly 100, 100' using the respective mullion assembly 30, 30' standardizes the construction of the window assemblies 100, 100', thereby reducing the cost of manufacturing the window assemblies 100, 100' as well as further inhibiting the leakage of water into and/or through the mullion assembly 30, 30'. Further, such factory mulling eliminates some or all of the costly and time consuming air and water penetration field testing (e.g., the AAMA 502 standard) that is ordinarily required of traditional field mull window assembly installations.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A mullion core assembly for use in a window assembly, comprising:

a one-piece monolithic body having a proximal surface and a distal surface, the body configured to be interposed between and fastened to a first window frame and a second window frame, the body comprising:

a first latch defined on a first side of the body and having a first latch opening facing in a first direction, a second latch defined on an opposite second side of the body and having a second latch opening facing in a second direction opposite the first direction, and a plurality of separate compartments defined along a length of the body vertically between the proximal and distal surfaces and laterally between the first and second latches, wherein the first and second latches are configured to couple to a pair of caps, at least one of the caps having a male catch insertable into one of the first and second latch openings and a flange configured to extend over and contact a surface of one of the first and second window frames disposed on either side of the body to thereby define a seal against and between the first and second window frames, and wherein the monolithic body is symmetrical about a central vertical axis of the body that extends from the proximal surface to the distal surface across a width of the body.

2. The mullion core assembly of claim 1, wherein the monolithic body is symmetrical about a central horizontal axis of the body.

3. The mullion core assembly of claim 1, further comprising a structural seal disposed between at least one of:

a horizontal portion of the proximal surface and a distal portion of the first window frame, a horizontal portion of the distal surface of the mullion core and a proximal portion of the second window frame, and a first cap of the pair of caps and the first and second window frames; and wherein the structural seal seals the mullion assembly against the first and second window frames to inhibit water leakage from a front facing side of the first and second window frames to a rear facing side of the first and second window frames, thereby inhibiting water leakage during use.

4. The mullion core assembly of claim 1, wherein the proximal and distal surfaces include stepped central portions that are stepped away from a central horizontal axis of the body relative to adjacent substantially horizontal portions.

5. The mullion core assembly of claim 4, wherein the first and second latches further comprise a proximal latch surface and a distal latch surface each of which is co-planar with the stepped central portions such that recessed portions are defined between the proximal and distal latch surfaces and the stepped central portions.

6. The mullion core assembly of claim 1, wherein the plurality of separate compartments is defined by a plurality of vertical walls extending between the proximal and distal surfaces.

7. The mullion core assembly of claim 1, wherein the monolithic body includes at least three compartments vertically between the proximal and distal surfaces and laterally between the first and second latches.

8. The mullion core assembly of claim 7, wherein the monolithic body includes four compartments vertically between the proximal and distal surfaces and laterally between the first and second latches.

9. The mullion core assembly of claim 1, wherein the proximal and distal surfaces are substantially parallel.

10. The mullion core assembly of claim 1, wherein the monolithic body further comprises a pair of flanges on the proximal and distal surfaces separating the proximal and distal surfaces from the first and second latches.

11. A mullion core assembly for use in a window assembly, comprising:

a monolithic body having a proximal surface and a distal surface, the body configured to be interposed between and fastened to a first window frame and a second window frame, the body comprising:

a first latch defined on a first side of the body and having a first latch opening facing in a first direction, a second latch defined on an opposite second side of the body and having a second latch opening facing in a second direction opposite the first direction, and a plurality of separate compartments defined along a length of the body vertically between the proximal and distal surfaces and laterally between the first and second latches, wherein the monolithic body is symmetrical about a central vertical axis and about a central horizontal axis of the body.

12. The mullion core assembly of claim 11, further comprising a structural seal disposed between at least one of:

a horizontal portion of the proximal surface and a distal portion of the first window frame, a horizontal portion of the distal surface of the mullion core and a proximal portion of the second window frame, and a first cap of a pair of caps coupleable to the first latch and the first and second window frames; and wherein the structural seal seals the mullion assembly against the first and second window frames to inhibit water leakage from a front facing side of the first and second window frames to a rear facing side of the first and second window frames, thereby inhibiting water leakage during use.

13. The mullion core assembly of claim 11, wherein the proximal and distal surfaces include stepped central portions that are stepped away from a central horizontal axis of the body relative to adjacent substantially horizontal portions.

14. The mullion core assembly of claim 13, wherein the first and second latches further comprise a proximal latch surface and a distal latch surface each of which is co-planar with the stepped central portions such that recessed portions are defined between the proximal and distal latch surfaces and the stepped central portions.

15. The mullion core assembly of claim 11, wherein the plurality of separate compartments is defined by a plurality of vertical walls extending between the proximal and distal surfaces.

16. The mullion core assembly of claim 11, wherein the monolithic body includes at least three compartments vertically between the proximal and distal surfaces and laterally between the first and second latches.

17. The mullion core assembly of claim 16, wherein the monolithic body includes four compartments vertically between the proximal and distal surfaces and laterally between the first and second latches.

18. The mullion core assembly of claim 11, wherein the proximal and distal surfaces are substantially parallel.

19. The mullion core assembly of claim 11, wherein the monolithic body further comprises a pair of flanges on the proximal and distal surfaces separating the proximal and distal surfaces from the first and second latches.

* * * * *